US005565836A

United States Patent [19]

Groehl et al.

[11] Patent Number: 5,565,836

[45] Date of Patent: Oct. 15, 1996

[54] NULLIFICATION OF MAGNETIC FIELDS RELATIVE TO COILS

[75] Inventors: Lawrence R. Groehl, Eatontown, N.J.; John M. O'Meara, Morrisville, Pa.

[73] Assignee: The United States of America as represented by the Secretary of the Army, Washington, D.C.

[21] Appl. No.: 359,669

[22] Filed: Dec. 20, 1994

[51] Int. Cl.[6] ..... H01F 27/28

[52] U.S. Cl. ..... 336/225; 336/181; 336/183; 336/184; 336/186; 324/117 R

[58] Field of Search ..... 336/225, 181, 336/183, 184, 186, 187; 324/117

[56] References Cited

U.S. PATENT DOCUMENTS

| | | | |
|---|---|---|---|
| Re. 33,345 | 9/1990 | Sylvester et al. | 336/180 |
| 3,439,305 | 4/1969 | Klein | 335/299 |
| 5,438,257 | 8/1995 | Berkcan | 324/117 |

*Primary Examiner*—Cassandra C. Spyrou
*Assistant Examiner*—G. R. Lord
*Attorney, Agent, or Firm*—Michael Zelenka; John M. O'Meara

[57] ABSTRACT

The internal and/or external magnetic fields of a coil are nullified to avoid structurally detrimental Lorentz Forces and/or environmentally hazardous magnetic fields, in accordance with preestablished design objectives.

12 Claims, 1 Drawing Sheet

NULLIFICATION OF MAGNETIC FIELDS RELATIVE TO COILS

GOVERNMENT INTEREST

The invention described herein may be manufactured, used, and licensed by or for the United States Government for governmental purposes without the payment to us of any royalties thereon.

BACKGROUND OF THE INVENTION

The use of coils or windings is well know in the electrical arts, such as in circuits, machinery and particle accelerators. Whenever current flows, a cylindrical magnetic field is sustained about the flow path thereof. Because the magnitude of that magnetic field is in proportion to the length of the current flow path, coils are generally constructed by winding turns about an axis and consecutive turns in series are commonly known as a winding. Relative to any coil, the magnetic field extends both internally and externally, except when ferromagnetic cores are incorporated therewith to eliminate either the internal or external magnetic fields in accordance with design objectives. However, the volume and weight of these cores severely limit such design objectives.

Although the magnetic fields of coils have many applications, they also present some serious problems. One such problem is that the structural integrity of coils is diminished by Lorentz Forces which result when the magnetic fields thereof interact with the current flowing therethrough. Another such problem is that the external magnetic fields of coils pass into the environment where they present significant hazards to life and equipment. One approach to addressing such problems is explained in a previously filed U.S. patent application by Lawrence R. Groehl entitled SUBSTANTIAL NULLIFICATION OF EXTERNAL MAGNETIC FIELDS AND LORENTZ FORCES REGARDING TOROIDAL INDUCTORS to which Ser. No. 08/260,151 was assigned.

SUMMARY OF THE INVENTION

It is the general object of the present invention to arrange windings within coils so that unnecessary magnetic field components thereof are nullified.

It is a specific object of the present invention to nullify internal and/or external magnetic field components of coils, in accordance with pre-established design objectives.

These and other objects are accomplished in accordance with the present invention by arranging at least two windings in coils, with the turns thereof wound about a common axis, at angles thereacross and passing current through the windings in the appropriate directions to sustain nullifying magnetic field components internally thereto along the axis and/or externally thereof perpendicularly to the axis. In one embodiment, both the internal and external magnetic field components of the windings are nullified for applications such as in circuitry. Only internal magnetic field components are nullified in another embodiment while cumulative external magnetic field components are derived for applications such as electric machinery. External magnetic field components only are nullified in still another embodiment, while cumulative internal magnetic field components are derived for applications such as particle accelerators.

The scope of the present invention is only limited by the appended claims for which support is predicated on the preferred embodiments set forth hereafter in the following description and the attached drawings wherein like reference characters relate to like parts throughout the several figures.

DESCRIPTION OF THE PREFERRED EMBODIMENTS

As disclosed in the previously mentioned application, the turns of main and supplemental windings can be arranged about separate axes in a toroidal coil to nullify both the structurally detrimental Lorentz Forces and the environmentally hazardous fields which result therefrom. To nullify the Lorentz Forces, the main winding turns are wound about the arcuate axis which is semetrically engulfed by the toroidal surface, at an angular orientation relative to that axis. The environmentally hazardous fields are nullified by disposing the supplemental winding turns about the circular axis of the toroidal configuration, at a perpendicular orientation relative to that axis. Sine and cosine components of the ampere turns in the main winding are derived from the angular orientation thereof, such that the Lorentz Forces resulting from the sine component nullify the Lorentz Forces which result from both the cosine component and the ampere turns of the supplemental winding. In all practical applications of coils, the structurally detrimental Lorentz Forces and environmentally hazardous fields thereof, are the result of the internal and/or external magnetic fields which are sustained thereby.

To address these same concerns, the coils of the present invention have at least two separate windings, incorporated therein with the turns of those windings arranged about a common axis, at angular orientations relative thereto such that an equivalent angle exists between each turn and the axis. For the preferred embodiments illustrated in FIGS. 2 and 3 respectively, the elements thereof are identified with numbers having prime and double prime suffixes associated therewith.

Figure 1:
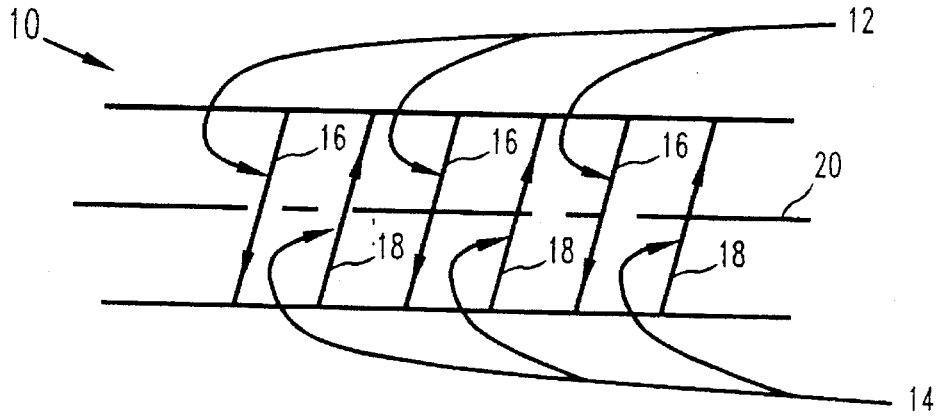
FIG. 1 is a plan view of the winding arrangement for one preferred coil embodiment with which both internal and external magnetic field components are nullified.

In the preferred embodiment of FIG. 1, a coil 10 contains windings 12 and 14 that include turns 16 and 18 respectively, which are adjacently arranged in parallel about a common axis 20, at an angular orientation thereacross. Windings 12 and 14 are electrically connected so as to pass current of equal magnitude, in opposite directions through the turns 16 and 18. Due to the angular orientation of the turns 16 and 18 relative to the common axis 20, current flow in each winding 12 and 14 induces or sustains an internal magnetic field component along the common axis 20 and an external magnetic field component perpendicularly to axis 20. Because opposing currents of equal magnitude flow in the turns 16 and 18, the internal and external magnetic field components of the windings 12 and 14 are also equal and opposite regardless of what angular orientation is selected therefor. Consequently, the respective internal and external magnetic field components of one winding 12 or 14 nullify the internal and external magnetic field components of the other winding 14 or 12, to thereby avoid both structurally deteriorating Lorentz Forces on the coil 10 and environmentally hazardous fields emanating therefrom.

Figure 2:
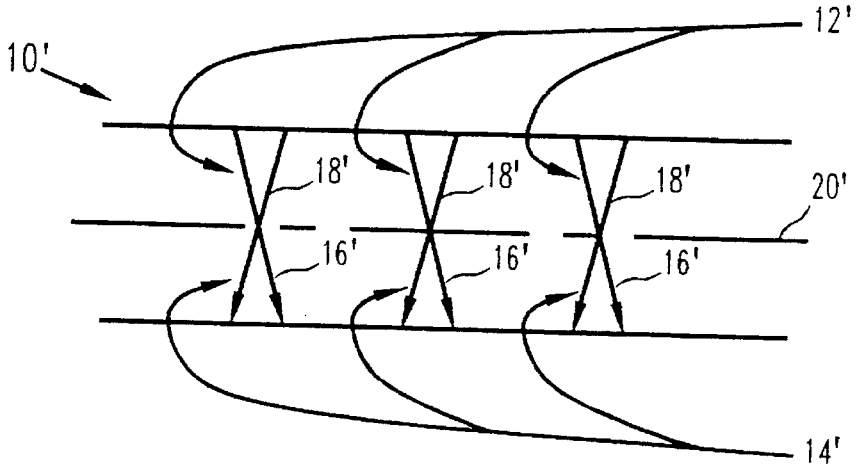
FIG. 2 is a plan view of the winding arrangement for another preferred coil embodiment with which only the external magnetic field components are nullified.

A coil 10' contains windings 12' and 14' which include turns 16' and 18' respectively, in the preferred embodiment of FIG. 2. The turns 16' and 18' are arranged about a common axis 20' and at an angular orientation thereacross, with the turns 16' or 18' of each winding 12' or 14' crossing the turns of the other winding and the perpendicular projection of the turns across the axis 20' presenting the same or equivalent angle of incidence for the turns of both windings 12' and 14' relative to that axis. Windings 12' and 14' are electrically connected to pass current of equal magnitude through the turns 16' and 18' thereof, in the directions indicated by the arrowheads. Current flow in each winding 12' and 14' sustains a magnetic field in accordance with the well known Right-handed-screw Rule. Due to the angular orientation of the turns 16' and 18' relative to axis 20', this magnetic field has an internal component along the axis 20' and an external component perpendicularly to that axis. Of these magnetic field components, the external components are nullifying, while the internal components are cumulative. Consequently, the coil 10' of this embodiment is useful in apparatus, such as particle accelerators wherein only the internal magnetic field is required for operation. Although structurally detrimental Lorentz Forces are encountered by the coil 10', no environmentally hazardous fields will emanate therefrom. Furthermore, to the extent that environmentally hazardous fields are permissible, the structurally detrimental Lorentz Forces can be nullified. An external magnetic field component of permissible magnitude is derived by disposing the windings 12' and 14' at differing angles of incidence relative to axis 20'. That angular difference is determined to derive Lorentz Forces in directions opposite to the Lorentz Forces which result from the cumulative internal magnetic field components, so that the latter forces are nullified accordingly. Also, the angular orientation of windings 12' and 14' could be selected to maximize the cumulative internal magnetic field components relative to the nullifying external magnetic field components.

Figure 3:
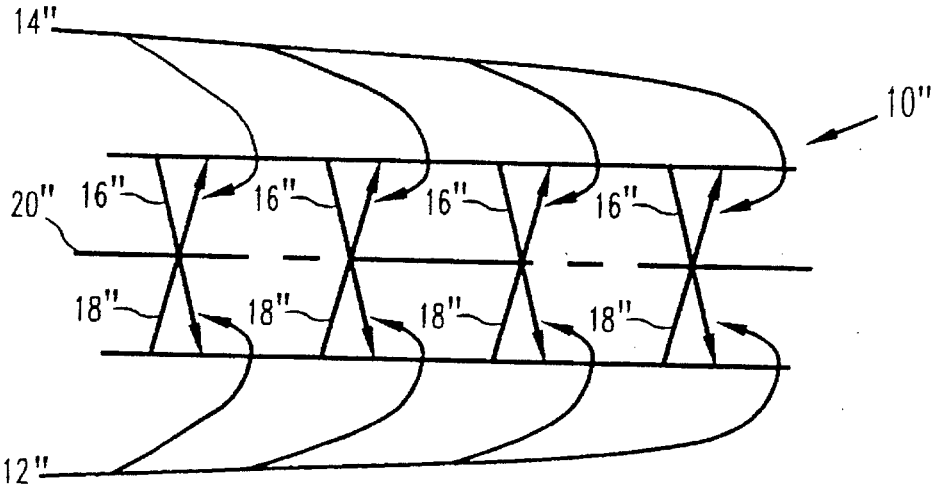
FIG. 3 is a plan view of the winding arrangement for still another preferred coil embodiment with which only the internal magnetic field components are nullified.

A coil 10" contains windings 12" and 14" which include turns 16" and 18" respectively, in the preferred embodiment of FIG. 3. The turns 16" and 18" are arranged about a common axis 20" and at an angular orientation thereacross, with the turns 16" or 18" of each winding 12" or 14" crossing the turns of the other winding and the perpendicular projection of the turns across the axis 20" presenting the same or equivalent angle of incidence for the turns of both windings 12" and 14" relative to that axis. Windings 12" and 14" are electrically connected to pass current of equal magnitude through the turns 16" and 18" thereof, in the directions indicated by the arrowheads. Current flow in each winding 12" and 14" again sustains a magnetic field in accordance with the well known Right-handed-screw Rule. Due to the angular orientation of the turns 16" and 18" relative to axis 20", this magnetic field has an internal component along the axis 20" and an external component perpendicularly to that axis. Of these magnetic field components, the internal components are nullifying while the external components are cumulative. Consequently, the coil 10" of this embodiment is useful in apparatus, such as electrical machinery wherein only the external magnetic field is required for operation. Although structurally detrimental Lorentz Forces are encountered from the external magnetic field components, no structurally detrimental Lorentz Forces are encountered from the nullifying internal magnetic field components. However, to the extent that internal magnetic fields are permissible, those structurally detrimental Lorentz Forces can be nullified. An internal magnetic field component of permissible magnitude is derived by disposing the windings 12" and 14" at differing angles of incidence relative to axis 20". That angular difference is determined to derive Lorentz Forces in directions opposite to the Lorentz Forces which result from the cumulative external magnetic field components, so that the latter forces are nullified accordingly. Furthermore, the angular orientation of windings 12" and 14" could be selected to maximize the cumulative external magnetic field components relative to the nullifying internal magnetic field components.

Design factors such as the magnitude of the magnetic fields to be sustained and whether the windings 12 and 14 are to be connected individually, in series or in parallel, must be known for each embodiment to determine the number and orientation angle of the turns 16 and 18, as well as the current which must pass through the windings 12 and 14. Once these factors are established however, well known electromagnetic and circuit theory can be applied to make those determinations. Otherwise, the common axis is linear in the embodiments of FIGS. 1, 2 and 3 however, the concept of this invention also applies to coils having circular or arcuate axes, such as those with toroidal configurations. Consequently, those skilled in the electromagnetic arts will appreciate without any further explanation that within the concept of this invention many modifications and variations are possible to the above disclosed embodiments thereof. Therefore, it should be understood that all such modifications and variations fall within the scope of the following claims.

What we claim is:

1. In a coil having turns in separate windings which are disposed about a common axis, the improvement comprising:

the turns of the windings are angularly oriented relative to the axis with an equivalent angle existing between each turn and the axis to result in equal internal and equal external magnetic field components being induced along the axis and perpendicularly to the axis respectively, by the turns when equal current is passed through the windings with the direction of current in the windings determined to derive cumulative and/or nullifying internal and external magnetic field components in accordance with the intended use of the coil.

2. The coil of claim 1 wherein the axis is linear.

3. The coil of claim 1 wherein the axis is arcuate.

4. The coil of claims 1 wherein the turns of the windings are arranged in parallel, with each turn of one winding adjacent to a turn of the other winding and nullifying internal and external magnetic field components are induced by passing equal current through the separate windings in opposite directions about the axis.

5. The coil of claim 4 wherein the axis is linear.

6. The coil of claim 4 wherein the axis is arcuate.

7. The coil of claim 1 wherein the turns of each winding are disposed to cross the turns of the other winding and cumulative external magnetic field components, along with nullifying internal magnetic field components are induced by passing equal current through the separate windings in opposite directions about the axis.

8. The coil of claim 7 wherein the axis is linear.

9. The coil of claim 7 wherein the axis is arcuate.

10. The coil of claim 1 wherein the turns of each winding are disposed to cross the turns of the other winding and cumulative internal magnetic field components, along with nullifying external magnetic field components are induced by passing equal current through the separate windings in the same direction about the axis.

11. The coil of claim 10 wherein the axis is linear.

12. The coil of claim 10 wherein the axis is arcuate.

* * * * *